United States Patent [19]

Carter et al.

[11] 4,362,642

[45] Dec. 7, 1982

[54] ALKYL PHOSPHORIC ACID POLYVALENT SALTS-MINERAL OIL LATHER CONTROLLED DETERGENT COMPOSITIONS

[75] Inventors: Malcolm N. A. Carter, Bromborough, England; Peter R. Garrett, Northop, Nr. Mold, Wales

[73] Assignee: Lever Brothers Company, New York, N.Y.

[21] Appl. No.: 280,973

[22] Filed: Jul. 7, 1981

Related U.S. Application Data

[63] Continuation of Ser. No. 757,165, Jan. 6, 1977, abandoned, which is a continuation of Ser. No. 55,714, Jul. 9, 1979, abandoned, which is a continuation of Ser. No. 162,987, Jun. 25, 1980, abandoned.

[30] Foreign Application Priority Data

Jan. 23, 1976 [GB] United Kingdom ..... 2670/76

[51] Int. Cl.[3] ..... C11D 3/36; C11D 11/00

[52] U.S. Cl. ..... 252/174.16; 252/135; 252/321; 252/351; 252/DIG. 17

[58] Field of Search ..... 252/132, 135, 140, 321, 252/358, 539, 540, 174.16, DIG. 17

[56] References Cited

U.S. PATENT DOCUMENTS

| | | | |
|---|---|---|---|
| 3,314,891 | 4/1967 | Schmolka et al. | 252/135 X |
| 3,399,144 | 8/1968 | Hathaway et al. | 252/99 |
| 3,523,902 | 8/1970 | Schmolka et al. | 252/540 X |
| 3,562,168 | 2/1971 | Wetmore et al. | 252/548 |
| 3,738,943 | 6/1973 | Kaneko | 252/540 |
| 3,770,855 | 11/1973 | Benson et al. | 260/987 |
| 3,869,412 | 3/1975 | Wäag | 252/527 |
| 3,957,661 | 5/1976 | Vérité | 252/8.9 |

FOREIGN PATENT DOCUMENTS

| | | |
|---|---|---|
| 912494 | 12/1962 | United Kingdom . |
| 1058239 | 2/1967 | United Kingdom . |
| 1300829 | 12/1972 | United Kingdom . |

*Primary Examiner*—P. E. Willis, Jr.

*Attorney, Agent, or Firm*—Milton L. Honig; James J. Farrell

[57] ABSTRACT

An insoluble polyvalent salt of a $C_{12}$–$C_{24}$ mono- or di-alkyl phosphoric acid is used as a lather controller in detergent compositions. The use of this material as lather controller is especially beneficial in built fabric washing detergent compositions.

18 Claims, No Drawings

ALKYL PHOSPHORIC ACID POLYVALENT SALTS-MINERAL OIL LATHER CONTROLLED DETERGENT COMPOSITIONS

This application is a continuation of application Ser. No. 757,165, filed Jan. 6, 1977, now abandoned, which in turn is a continuation of application Ser. No. 055,714, filed July 9, 1979, now abandoned, which in turn is a continuation of application Ser. No. 162,987, filed June 25, 1980, now abandoned.

The invention relates to detergent compositions, and in particular to detergent compositions adapted for fabric washing.

It is an important requirement of detergent compositions in general that they should exhibit appropriate lather or sudsing properties, dependent on the particular conditions of use expected for those compositions. Some detergent compositions, especially those intended for hand washing use at relatively low temperatures, should generally be able to produce a copious lather at such temperatures. However, detergent compositions for use in many automatic washing machines should generally speaking have fairly low lather properties, as otherwise excessive lathering can cause overflowing from the machines. But the total suppression of lather is generally not desirable, as the consumer often assesses produce performance and product dosing amounts by the lather level.

Many methods of controlling the lather in detergent compositions, especially in detergent compositions for fabric washing, have been proposed hitherto. Perhaps the most common system in present commercial practice is the use of special so-called mixed ternary detergent active systems, which most commonly comprise a synthetic anionic detergent compound, a nonionic detergent compound and a soap, especially a soap of a long chain fatty acid, i.e. about $C_{18}$–$C_{24}$. However, these systems often do not give the ideal lather performance which would be desired, for example they may tend to suppress the lather at lower rather than high temperatures, and they tend to be relatively expensive. Moreover, production of such compositions can be inconvenient as they have to be made entirely separately from other types of detergent compositions. It would clearly be preferable to have an efficient and economical lather control system for detergent compositions which could be used very simply by adding it to standard detergent base formulations so as to convert otherwise high sudsing compositions into controlled low sudsing compositions.

It has been proposed to use several lather controlling additives in detergent compositions, but none of those suggested has been wholly acceptable so far. For example, silicones tend to be very expensive and they can be difficult to incorporate into detergent compositions in such a manner as to retain full lather control properties. Alternatively, alkyl phosphoric acids and their alkali metal salts have been proposed for use as lather controllers, but they tend to give variable performance depending on the conditions of use, and are relatively ineffective with high sudsing detergent active compounds such as alkyl benzene sulphonate or alkyl sulphonates except at impracticable or uneconomic levels.

According to the present invention, a detergent composition comprises an insoluble polyvalent salt of an alkyl phosphoric acid as lather controller. The insoluble salts, preferably the calcium salts of the alkyl phosphoric acids as described more fully below, are relatively economical and give efficient lather control properties during use.

The alkyl phosphoric acids which are used in insoluble polyvalent salt form have the following general formula:

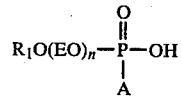

(I)

where A is —OH or $R_2O(EO)_m$—, $R_1$ and $R_2$ are the same or different $C_{12}$–$C_{24}$, preferably $C_{16}$–$C_{22}$, straight or branched chain, saturated or unsaturated alkyl groups, especially $C_{16}$–$C_{18}$ linear saturated alkyl groups, and m and n are the same or different and are 0 or an integer of from 1 to 6. Preferably A is —OH and n is 0, so that the compounds are the monoalkyl phosphoric acids, preferably with linear alkyl groups. If any ethylene oxide (EO) groups are present in the alkyl phosphoric acid, they should, of course, not be too long in relation to the alkyl chain length to make the solid salts soluble in use.

In practice, the compounds are commonly mixtures of both mono- and di-alkyl phosphoric acids, with a range of alkyl chain lengths. Predominantly monoalkyl phosphates are usually made by phosphorylation of alcohols, or ethoxylated alcohols when m or n is 1 to 6, using a polyphosphoric acid. Phosphorylation may alternatively be accomplished using phosphorus pentoxide, in which case the mixed mono- and di-alkyl phosphates are produced. Under optimum reaction conditions only small quantities of unreacted materials or by-products can advantageously be used directly to make the detergent compositions.

The substituted phosphoric acids of formula (I) above are used as stated in insoluble salt form, that is either as the partial or preferably full salt with a polyvalent cation which is preferably calcium, though aluminium, barium, zinc, magnesium or strontium salts may alternatively be used. Mixtures of the insoluble alkyl phosphoric acid salts with the free acid or other soluble e.g. alkali metal salts may also be used if desired. The insoluble alkyl phosphoric acid salts need not be totally insoluble in the detergent systems but they should be sufficiently insoluble that undissolved solid salt is present in the detergent systems during use.

The amount of the insoluble alkyl phosphoric acid salt used in the detergent compositions can be varied widely from a minimum level of about 0.05% up to a practical maximum of about 20%, preferably about 0.1% to about 5% by weight. Higher levels than 20% can be employed but this would be uneconomical and would generally not give any product advantages.

The detergent compositions of the invention essentially include one or more detergent compounds which may be anionic (soap or non-soap), nonionic, zwitterionic or amphoteric in nature. Many suitable detergent compounds are commercially available and they are fully described in the literature, for example in "Surface Active Agents and Detergents", Volumes I and II, by Schwartz, Perry & Berch.

Specific preferred detergent compounds which may be mentioned are synthetic anionic detergent compounds, which are usually water soluble alkali metal salts of organic sulphates and sulphonates having alkyl radicals containing from about 8 to 22 carbon atoms, the term alkyl being used to include the alkyl portion of higher acyl radicals. Examples of suitable synthetic anionic detergent compounds are sodium and potassium alkyl sulphates, especially those obtained by sulphating the higher ($C_8$–$C_{18}$) alcohols produced by reducing the glycerides of tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$) fatty alcoholalkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; and olefin sulphonates, which term is used to describe the material made by reacting olefins, particularly alpha-olefins, with $SO_3$ and the neutralising and hydrolysing the reaction product.

If desired, nonionic detergent active compounds may alternatively or additionally be used. Examples of nonionic detergent compounds include the reaction products of alkylene oxides, usually ethylene oxide, with alkyl ($C_6$–$C_{22}$) phenols, generally 5 to 25 EO; i.e. 5 to 25 units of ethylene oxide per molecule; the condensation products of aliphatic ($C_8$–$C_{18}$) primary or secondary alcohols with ethylene oxide, generally 6 to 30 EO; and products made by the condensation of ethylene oxide with the reaction products of propylene oxide and ethylenediamine. Other so-called nonionic detergent active compounds include long chain tertiary amine oxides, long chain tertiary phosphine oxides and dialkyl sulphoxides, which are properly semi-polar compounds.

Mixtures of detergent active compounds, for example mixed anionic or mixed anionic and nonionic compounds may be used in the detergent compositions, if desired.

Amounts of amphoteric or zwitterionic, e.g. sulphobetaine detergent compounds, can also be used in the compositions of the invention but this is not normally desired due to their relatively high cost. If any amphoteric or zwitterionic detergent active compounds are used, it is generally in small amounts in compositions based on the much more commonly used anionic and/or nonionic detergent compounds, for example mixtures of nonionic compounds and sulphobetaines. Likewise, low levels of cationic compounds may be used but only in conjunction with larger amounts of other detergent compounds.

The amount of the detergent compound or compounds used may be varied widely, from a minimum of about 1% up to a maximum of about 90% by weight, depending on the type of detergent composition concerned. However, in the case of the preferred detergent compositions for fabric washing purposes, the amount of the detergent compounds is generally in the range from about 5% to about 50% by weight, preferably about 7% to about 20% by weight.

It is also preferred to include a detergency builder in the detergent compositions of the invention, especially in such compositions which are adapted for fabric washing. The detergency builders function to decrease the calcium ion concentration in wash liquors, usually either by sequestering the hard water ions present or by forming insoluble salts with the calcium and/or magnesium ions. Several suitable detergency builders are well known and commercially available, whilst many more have been described in the literature, especially in recent patent specifications on replacements for the conventional condensed phosphate builders such as sodium tripolyphosphate and sodium pyrophosphate. Other detergency builders which may be mentioned by way of example, are alkali metal carbonates and orthophosphates, especially sodium carbonate and trisodium orthophosphate, alkali metal polyphosphonates, e.g. sodium ethane-1-hydroxy-1,1-diphosphonate, alkali metal amine carboxylates, such as sodium nitrilotriacetate and sodium ethylenediamine tetraacetate, alkali metal ether carboxylates, such as sodium oxydiacetate, sodium carboxymethyloxysuccinate, sodium carboxymethyloxymalonate and homologues thereof, alkali metal citrates, alkali metal mellitates, and salts of polymeric carboxylic acids, such as sodium polymaleate, copolyethylenemaleate, polyitaconate and polyacrylate. When sodium carbonate is used as a detergency builder, it is advantageous to have present some calcium carbonate having a surface area of at least 10 $m^2/g$, as described in U.K. Pat. No. 1,437,950.

Another type of detergency builder which can be used, either alone or in admixture with other builders, is a cation exchange material, especially a sodium aluminosilicate such as described in U.K. Pat. No. 1,429,143 or in Netherlands patent application 7403381. Preferred materials of this type have the formula:

$$(Na_2O)_{0.7-1.1}.Al_2O_3.(SiO_2)_{1.3-3.3}$$

and may be amorphous or crystalline, with some bound water usually in an amount of about 10–30% depending on the drying conditions used. Such sodium aluminosilicate materials should, of course, be very finely divided so as to minimise deposition on the fabrics during washing.

The amount of the detergency builder which is used as normally from about 5% up to about 80% by weight of the composition, preferably about 10% to about 60%, and the ratio by weight of the detergency builders to the detergent active compounds which are used is generally from about 10:1 to about 1:5 parts by weight.

The lather controlling properties of the present invention are particularly beneficial with built fabric washing detergent compositions based on anionic detergent compounds, which otherwise tend to be high sudsing with difficult lather control problems.

It is important to have the insoluble alkyl phosphoric acid salt in a preformed condition in the detergent composition, that is either by admixing the insoluble salt with other detergent ingredients to form the final product or by precipitating the insoluble salt during the actual production of the detergent composition itself, for example in a detergent slurry making process. A preferred way of incorporating the insoluble alkyl phosphoric acid salt in a detergent composition, is to disperse the salt in a liquid or melted detergent ingredient such as a nonionic detergent compound, and to add the resultant mixture to the composition, for example by spraying onto a detergent composition in powder form, or by spraying onto a solid carrier material such as sodium perborate mono- or tetra-hydrate and then admixing this with a detergent base powder. Alternatively, a mixture of an insoluble alkyl phosphoric acid salt and a nonionic detergent compound may be admixed with a detergent slurry immediately prior to spray drying, which technique tends to overcome the common problem of nonionic separation in the slurry. Whatever process is used, the insoluble alkyl phosphoric acid salt should be in finely divided particulate form in the product and readily dispersible throughout the wash liquor in use. It is preferred to have an average particle size of about 0.1–25$\mu$, with a maximum particle size of not more than about 50$\mu$, though it is possible to use initially larger particles of the alkyl phosphate salts provided they are broken down during processing.

It is preferred to incorporate the insoluble phosphoric acid salt into a detergent composition in conjunction with a solid or liquid hydrocarbon material, which has a beneficial effect on the lather control properties of the detergent compositions. The hydrocarbons do not alone have adequate lather control properties at the relatively low levels usually used, but they appear to act synergistically with the insoluble alkyl phosphoric acid salts to give improved lather control at lower levels of the salts than would otherwise be required. In addition the presence of the hydrocarbons changes the lather profiles during use, depending on the specific hydrocarbons used and the methods of incorporation in the compositions, usually to give greater lather control at higher wash temperatures.

Examples of suitable liquid hydrocarbons are mineral, vegetable or animal oils of which colourless mineral oils are preferred. Either light or heavy mineral oil or mixtures thereof may be employed, but of course any liquid hydrocarbon used must be of low volatility at fabric washing temperatures. Other oils which could be used if desired are vegetable oils such as sesame oil, cotton seed oil, corn oil, sweet almond oil, olive oil, wheat germ oil, rice bran oil or peanut oil, or animal oils such as lonolin, neat's foot oil, bone oil, sperm oil or cod liver oil. Any such oils used should of course not be highly coloured, of strong odour or otherwise unacceptable for use in a detergent composition.

Suitable solid hydrocarbons are waxes, which are water insoluble materials of either synthetic, mineral, vegetable or animal origin and are dispersible in the detergent solutions. The waxes should normally melt at a temperature between about 20° C. and about 120° C., preferably not more than 90° C. and especially about 30° C. to about 70° C., i.e. lower than the maximum intended wash temperatures for the detergent compositions. When waxes having melting points above the maximum intended wash temperatures are used they should be adequately dispersed in the wash liquor by suitable incorporation in the original detergent compositions.

The preferred waxes are of mineral origin, especially those derived from petroleum, including microcrystalline and oxidised microcrystalline petroleum waxes, petroleum jelly ("Vaseline") and paraffin waxes. Petroleum jelly is correctly a semi-solid wax, usually having a mp about 30°–40° C., but is here for convenience grouped with other solid waxes. Synthetic waxes such as Fischer-Tropsch and oxidised Fischer-Tropsch waxes, or Montan waxes, or natural waxes such as beeswax, candelilla and carnauba waxes may be used if desired. Any of the waxes described may be used alone or in admixture with other waxes or with other hydrocarbon oils as described above. The waxes should be readily dispersible in the detergent liquor but not soluble therein, and preferably they should not have very high saponification values, eg not in excess of about 100. It is advantageous to include emulsifying or stabilising agents for the waxes in the compositions.

The insoluble phosphoric acid salts, and any hydrocarbons used, may be added separately to the detergent compositions, either to the finished products or during detergent processing for example by admixture in a slurry prior to spray drying, but it is preferred to add them together in substantially homogeneous admixture. When liquid hydrocarbons are used, the additive mixture is most conveniently sprayed onto powdered detergent compositions. If the hydrocarbon is a solid material, the additive mixture is preferably also sprayed in melt form onto the detergent compositions, but it may also be made in granular form for admixture with powdered detergent compositions. Granulation of the detergent additives may be accomplished readily, for example by extrusion processes to form noodles or by mixing techniques, for example in pan granulators. Granulation may also be aided by adding fillers which preferably also have detergent properties, for example sodium carbonate, sodium perborate mono- or tetra-hydrate, or sodium tripolyphosphate.

One aspect of the present invention is the provision of these detergent additives themselves, which comprise an insoluble salt of an alkyl phosphoric acid of formula (I) above together with a solid or liquid hydrocarbon material in substantially homogeneous admixture, and processes for the production of detergent compositions using the additives. It will be appreciated that these detergent additives can be used in detergent compositions intended for purposes other than fabric washing, for example in dishwashing detergent products or for other purposes where lather suppression is desirable.

The proportion of insoluble alkyl phosphoric acid salt to the hydrocarbon in the lather controlling detergent additives can be varied widely from about 1:250 to about 10:1 parts by weight, preferably from about 1:20 to about 10:1 parts by weight, especially from about 1:10 to about 1:1 parts by weight. The amount of the hydrocarbon should normally be from about 0.05% to about 20%, preferably from about 0.5% to about 5% by weight of the composition. The total amount of the insoluble alkyl phosphoric acid salt and the hydrocarbon is generally from about 0.2% to about 20% by weight of the composition, preferably about 0.5% to about 10% by weight.

The use of hydrocarbon waxes with both the insoluble alkyl phosphoric acid salts according to the present invention and other salts of alkyl phosphoric acids is described in the specification of our copending U.S. patent application No. 757,164 of even date, now abandoned (reference cC.780).

The detergent compositions of the invention may take any of the usual physical forms, preferably as solid compositions, for example as powders, granules, flakes, ribbons, noodles or tablets, or they may be in liquid or paste form. The detergent compositions may also be made by any of the conventional processes for making detergent compositions, especially by the technique of slurry making and spray drying in the case of the preferred powdered detergent compositions.

The detergent compositions of the invention may also include any of the conventional optional additives in the amounts usually employed in detergent compositions. Examples of these additives include powder flow aids such as finely divided silicas and aluminosilicates, other lather controllers, anti-redeposition agents such as sodium carboxymethylcellulose, oxygen-releasing bleaching agents such as sodium perborate and sodium percarbonate, per-acid bleach percursors such as tetraacetylethylenediamine, chlorine-releasing bleaching agents such as trichloroisocyanuric acid and alkali metal salts of dichloroisocyanuric acid, fabric softening agents such as clays of the smectite and illite type, anti-ashing aids, starches, slurry stabilisers such as copolyethylene-maleic anhydride and copolyvinylmethylether-maleic anhydride, which are usually in salt form, inorganic salts such as sodium silicates and sodium sulphate, and usually present in very minor amounts, fluorescent agents, perfumes, enzymes such as proteases and amylases, germicides and colourants. Dispersing aids and emulsifying agents may also be present if desired, to facilitate dispersion of the insoluble alkyl phosphoric acid salts in the detergent solutions, or in the hydrocarbons to form the separate detergent additives. The detergent compositions usually have an alkaline pH, generally in the region of pH 9–11, which is achieved by the presence of alkaline salts especially sodium silicate such as the meta-, neutral or alkaline silicates, preferably at levels up to about 15% by weight.

The invention is illustrated by the following Examples in which parts and percentages are by weight except where otherwise indicated.

EXAMPLE 1

An aqueous detergent solution was prepared having a concentration of 5 gm/l of the following detergent composition:

| Ingredient | % |
|---|---|
| Sodium alkyl benzene sulphonate | 17.4 |
| Sodium tripolyphosphate | 40.9 |
| Sodium alkaline silicate | 10.1 |
| Sodium sulphate | 18.9 |
| Sodium carboxymethylcellulose | 0.7 |
| Water + minor ingredients | 12.0 |

The aqueous solution was found to have a pH of 9.7 at 20° C. The effect of antifoam systems on the foaming properties of the aqueous solution prepared as described above, was determined by a standard test procedure in which 50 mls of the aqueous solution was shaken for a set time at 86° C. in a graduated cylinder and the foam height was then measured. The tests were undertaken using both soft (demineralised) water and water of 50° H. (French) ($5\times10^{-3}$M $Ca^{2+}$) for making the detergent solutions and with the antifoam systems used at 0.06 gms in 50 mls of the aqueous solutions.

The results were as follows:

TABLE I

| | Total Lather and Liquor Volume | | | |
|---|---|---|---|---|
| | Soft Water | | Hard Water | |
| Antifoam System | Initial | After 1 hr | Initial | After 1 hr |
| Antifoam A[1] | 110 | 130 | 110 | 130 |

TABLE I-continued

| | Total Lather and Liquor Volume | | | |
|---|---|---|---|---|
| | Soft Water | | Hard Water | |
| Antifoam System | Initial | After 1 hr | Initial | After 1 hr |
| None | >250[2] | >250[2] | >250[2] | >250[2] |

[1]20 parts of calcium alkyl phosphate, prepared by neutralising a predominantly $C_{16}$-$C_{18}$ monoalkyl acid phosphate dispersed in 80 parts of clear liquid paraffin obtained under the tradename "Nujol".
[2]The total lather and liquor volume was restricted to this figure by the apparatus used.

These results show very good lather control at the high temperature employed for the test. It is noticeable in particular that good lather control is achieved in both the soft and hard water, whereas the use of the alkyl acid phosphoric acid as such or in soluble alkali metal salt form is largely ineffective in soft water. Similarly good results to those for antifoam system A were achieved for an antifoam system B in which the 20 parts of calcium alkyl phosphate were replaced by a mixture of 10 parts of the monoalkyl phosphate neutralised to form the calcium salt and 10 parts of the monoalkyl acid phosphate itself, or when the calcium alkyl phosphate in antifoam system A was replaced by 20 parts of either calcium monostearyl phosphate or strontium monostearyl phosphate.

The effectiveness of the antifoam system B in a practical wash system was assessed by a test in a Miele 429 automatic washing machine using soft water with 80.8 gm of the detergent formulation given above, 19.2 gm of sodium perborate and 5 gm of antifoam B in the main wash cycle. The lather generated in the washing machine was kept within acceptable limits with a maximum of about 20% of the free space above the wash liquor in the machine until the end of the wash cycle. However, when the test procedure was repeated except that the antifoam system used was one in which the alkyl phosphate was added wholly in acid form instead of in calcium salt form, then the lather generated during the wash was excessive and lather overflowing commenced about 3½ minutes after the start of the wash cycle and the test had to be discontinued.

EXAMPLES 2 TO 4

A series of tests were undertaken in a modified dynamic Ross-Miles-type Foameter, in which a solution of 8 gm of detergent base composition as described in Example 1 was admixed with 0.625 gm of antifoam additive in 2,500 mls water of varying degrees of hardness. The solution was then agitated under standard conditions and the volume of foam generated was observed, with the following results, which include two comparative antifoam additives C and D.

TABLE II

| | | Foam Height (cms) | | |
|---|---|---|---|---|
| Example | Antifoam Additive | 0° H | 6° H | 24° H |
| 2 | Calcium alkyl phosphate[1] (20 pts) Mineral oil[2] (80 pts) | 10 | 10 | 12 |
| 3 | Magnesium alkyl phosphate[1] (20 pts) Mineral oil[2] (80 pts) | 48 | — | — |
| Comparative C | Alkyl phosphoric acid[1] (20 pts) Mineral oil[2] (80 pts) | 100+ | 42 | 14 |
| 4 | Calcium alkyl phosphate[3] (20 pts) Mineral oil[2] (80 pts) | 8 | — | 6 |
| Comparative D | Alkyl phosphoric acid[3] (20 pts) | 74 | 5 | 6 |

TABLE II-continued

| Example | Antifoam Additive | Foam Height (cms) 0° H | 6° H | 24° H |
|---|---|---|---|---|
| | Mineral oil[2] (80 pts) | | | |

[1]As used in Example 1, antifoam system A.
[2]As used in Example 1, ("Nujol" mineral oil).
[3]Prepared from a predominantly $C_{20}$ alcohol blend obtained under the tradename "Alfol 20/22", by phosphorylation to give the predominantly monoalkyl phosphoric acid and then neutralisation to give the calcium salt.

Comparison of the results for Examples 2 and 3 with additive C, and Example 4 with additive D, shows increased lather control in the soft water in particular, and similar or slightly improved lather control in hard water, with the calcium salt of Example 2 being better than the magnesium salt of Example 3.

EXAMPLE 5

The procedure of Example 4 was repeated except that the ratio of the calcium alkyl phosphate to mineral oil was varied and a decreased level of 0.156 gm of the mixed antifoam additive was used. The amounts of lather generated were measured at 0° H. under increased agitation and increasing temperature, and the maximum volumes found as follows:

| Ratio of calcium alkyl phosphate to mineral oil | Foam Height (cms) |
|---|---|
| 10:90 | 48 at 65° C. |
| 20:80 | 13 at 65° C. (little change between 50° and 90° C.) |
| 30:70 | 26 at 80° C. (little change between 55° and 85° C.) |

EXAMPLES 6 TO 9

The lather control properties of a series of antifoam additives were assessed in a Miele 429 washing machine using about 79 gm of a detergent composition similar to that described in Example 1 except that the alkyl benzene sulphonate was replaced with a nonionic detergent compound (sec-($C_{11}$–$C_{15}$)alcohol-7EO, obtained as Tergitol 15-S-7). The maximum lather volume in the machine was measured in the main wash cycle at 95° C. as a proportion of the free head space (ie 0.5 is half full, 1.0 is full), with the following results for washing a 5 lb clean laundry load, including those for a comparative composition E.

TABLE III

| Example | Antifoam Additive[1] | Amount | Lather Volume (at 0° H) |
|---|---|---|---|
| 6 | Calcium alkyl phosphate (10 pts)<br>Alkyl phosphoric acid (10 pts)<br>Mineral oil (80 pts) | 0.31 gm | 0.95 |
| 7 | Calcium alkyl phosphate (20 pts)<br>Mineral oil (80 pts) | 0.31 gm | 0.9 |
| 8 | Calcium alkyl phosphate (20 pts)<br>Mineral oil (80 pts) | 0.625 gm | 0.75 |
| 9 | Calcium alkyl phosphate (20 pts)<br>Mineral oil (80 pts) | 0.625 gm | 0.5 |
| E | Alkyl phosphoric acid (20 pts)<br>Mineral oil | 0.625 gm<br>(80 pts) | 1.0 |

[1]The calcium alkyl phosphate and alkyl phosphoric acids used in Examples 6 to 8 and comparative test E were the same as in Example 1, and in Example 9 was the same as in Example 4. The mineral oil used was the same as in Example 1 in all cases.

EXAMPLES 10 TO 15

The lather controlling properties of several synthetic calcium mono- and di-alkyl phosphates were evaluated in a standard lather test as described in Example 1 except that 25 mls of the detergent solution were used and 0.03 gm of the antifoam additives were added to the solution in each test. Each of the antifoam additives consisted of 1 gm of calcium salt in 25 mls paraffin oil (BDH quality, SG 0.83–0.89 at 20° C.). The detergent solutions were made up using tap water of 13° H., and the following results were obtained for the lather volume at room temperature (RI) and at 90° C. (25 indicates no lather and 100 is the maximum lather measurable).

| Example | Calcium alkyl phosphate type | Total Lather and Liquor Volume RI | 90° C. |
|---|---|---|---|
| 10 | $C_{16}$ monoalkyl | 50 | 83 |
| 11 | $C_{18}$ monoalkyl | 58 | 25 |
| 12 | $C_{20}$ monoalkyl | 61 | 89 |
| 13 | $C_{22}$ monoalkyl | 58 | 72 |
| 14 | $C_{16}$ dialkyl | 60 | >100 |
| 15 | $C_{18}$ dialkyl | 63 | >100 |
| | None | >100 | >100 |

These results show that all of the calcium $C_{16}$–$C_{22}$ monoalkyl phosphates were effective lather controllers at both room temperature and high temperature (90° C.). The calcium $C_{16}$–$C_{18}$ dialkyl phosphates were effective at room temperature but not very effective at the high temperature. Further comparative tests against the corresponding alkyl phosphoric acids showed all of the corresponding calcium salts used to be equally effective or more effective at either or both of the temperatures tested. The calcium $C_{18}$ monoalkyl phosphate was especially effective, in controlling the lather completely at 90° C. Further tests on this preferred calcium salt showed it to still be slightly effective at lower concentrations in the paraffin oil, down to 0.1 gm of the calcium salt in 25 mls oil; ie a total concentration of only about $0.55\times10^{-3}$ gm per 100 ml detergent solution (equivalent to only about 0.1% of the calcium salt per 100 gm detergent composition).

Similar tests were performed using the aluminium, magnesium, zinc, barium and strontium salts instead of the calcium $C_{18}$ monoalkyl phosphate. The results showed that all the salts gave some foam controlling effect at room temperature, but only the strontium salt was also effective at high temperature.

Further tests were also undertaken using the same procedure but with the calcium $C_{18}$ monoalkyl phosphate replaced by a 1:1 mixture of the calcium salt and the corresponding $C_{18}$ monoalkyl phosphoric acid, when the lather was still controlled but less effectively than with the equivalent total amount of the calcium alkyl phosphate.

EXAMPLES 16 AND 17

The procedure of Examples 6 to 9 was repeated in a Miele 429 washing machine using 100 gm of a detergent composition of the following formulation and 5 gm of an antifoam additive to wash a 5 lb soiled laundry load in 24° H water.

| Ingredient | % |
|---|---|
| Sodium alkyl benzene sulphonate | 14.0 |
| Sodium tripolyphosphate | 33.0 |
| Sodium alkaline silicate | 8.5 |
| Sodium sulphate | 15.3 |

-continued

| Ingredient | % |
|---|---|
| Sodium carboxymethylcellulose | 0.5 |
| Sodium perborate | 19.2 |
| Water and minor ingredients | 9.5 |

The lather performance was as follows for the different additives:

| Example | Antifoam Additive | Maximum Foam Level |
|---|---|---|
| 16 | 1 pt calcium alkyl phosphate[1] 4 pts liquid paraffin[2] (mixed thoroughly together) | 0.2 |
| 17 | 1 pt calcium alkyl phosphate[1] 4 pts liquid paraffin[2] (added separately) | 1.0 |
| | None | Overflowed |

[1]As used in Example 1.
[2]Liquid paraffin supplied by Hopkins & Williams Limited.

The results show that best lather control is achieved by using the thoroughly mixed calcium alkyl phosphate in paraffin oil, but some degree of lather control is still achieved using the separate ingredients.

EXAMPLES 18 AND 19

The procedure of Example 16 was repeated except that the liquid paraffin was replaced by petroleum jelly (Example 18) or paraffin wax having a melting point of 41° C. (Example 19). It was found that with the petroleum jelly the lather volume again increased gradually, but the maximum foam level reached was only about 0.25 at the end of the wash cycle. Using the paraffin wax, a peak in lather volume of about 0.75 was reached after 5 minutes in the wash cycle then the lather collapsed and remained generally constant at a level of about 0.2.

EXAMPLE 20

A detergent composition was prepared as shown below, all the ingredients being added to the detergent slurry during its production:

| Ingredient | Parts (dry basis) |
|---|---|
| Sodium alkyl benzene sulphonate | 14 |
| Calcium alkyl phosphate[1] | 1 |
| Petroleum jelly | 4 |
| Sodium tripolyphosphate | 33 |
| Sodium alkaline silicate | 6 |
| Sodium sulphate | 20.3 |
| Minor ingredients | 0.6 |

[1]The calcium alkyl phosphate was formed in the detergent slurry by reaction between alkyl phosphoric acid (as in Example 1) and calcium chloride.

The detergent composition was used to wash clothes in a Miele 429 automatic washing machine using the procedure described for Examples 6 to 9, except that the amount of the detergent composition used was 78.9 gm (dry basis) and that hard water (24° H) was used. The lather was found to increase progressively throughout the wash cycle but reached the acceptable level of only 0.5, ie half full by the end of the wash cycle. Without the lather controlling ingredients present, the lather was found to overflow severely within a few minutes of washing commencing.

EXAMPLES 21 TO 24

A series of tests were undertaken using a modified dynamic Ross-Miles-type Foameter as in Examples 2 to 4. The test solutions were formed by dissolving in 2,500 mls of 0° H water the following ingredients:

| Ingredient | Amount (gms) |
|---|---|
| Sec-linear $C_{11}$–$C_{15}$ alkyl - 7 EO | 3.0 |
| Sodium tripolyphosphate | 4.1 |
| Sodium alkaline silicate | 2.2 |
| Sodium sulphate | 1.9 |
| Calcium alkyl phosphate[1] | 0.0125 |

[1]In Examples 21 and 23 the calcium alkyl phosphate was calcium mono $C_{22}$ alkyl phosphate, and in Examples 22 and 24 the calcium alkyl phosphate was prepared from a commercially available mixture of predominantly $C_{16}$–$C_{18}$ monoalkyl acid phosphate. In Examples 21 and 22 the calcium alkyl phosphate was admixed thoroughly with the nonionic detergent compound before being added to the other ingredients, whilst for Examples 23 and 24 the calcium alkyl phosphate was dispersed in 0.05 gms of mineral oil before admixture with the other ingredients to form the test solutions.

The maximum lather heights were found to be as follows (compared with a control formulation with no added calcium alkyl phosphate):

| Example | Maximum Lather Height (cms) |
|---|---|
| Control | 70 (at 40° C.) |
| 21 | 32 (at 40° C.) |
| 22 | 42 (at 40° C.) |
| 23 | 14 (at 30° C.) |
| 24 | 5 (at 30° C.) |

These results show very marked lather control properties in the nonionic detergent systems by using the calcium alkyl phosphates, especially when they are predispersed in the mineral oil. Further comparative tests under similar conditions showed $C_{16}$–$C_{22}$ monoalkyl phosphoric acids to be largely ineffective.

Some further tests were done as in Examples 21 and 22 except that the calcium alkyl phosphates were formed in the test solution by reaction at 85° C. between 0.0125 g of alkyl phosphoric acid and 0.00816 gms of calcium chloride dihydrate in the presence of the sodium silicate and the nonionic detergent compound in 200 mls of 0° H water, followed by addition of the other ingredients. The results gave maximum lather heights of 11 cms and 41 cms, respectively, both of which were much better than when the monoalkyl phosphoric acids were used themselves. In other tests the nonionic compound used was tallow alcohol-18 EO, which was found to be effective as a carrier for the calcium alkyl phosphate, either by spraying the molten mixture onto a detergent base powder or onto a sodium perborate which was then admixed with the base powder.

EXAMPLE 25

A granular detergent additive was made by melting together 1 part calcium $C_{16}$–$C_{18}$ monoalkyl phosphate and 4 parts of petroleum jelly and then admixing the melt at 80° C. with 19.2 parts of sodium perborate tetrahydrate in an inclined pan. The resultant granular additive was then added to 80.8 parts of a detergent base formulation of the formula:

| Ingredient | Parts |
|---|---|
| Sodium alkyl benzene sulphonate | 14.0 |
| Sodium tripolyphosphate | 33.0 |
| Sodium alkaline silicate | 8.5 |

-continued

| Ingredient | Parts |
|---|---|
| Sodium sulphate | 15.3 |
| Sodium carboxymethylcellulose | 0.5 |
| Sodium ethylenediaminetetraacetate | 0.1 |
| Water | 9.4 |

The lather properties of the resultant composition were then evaluated in a Miele 429 washing machine, when it was found that very little lather was generated throughout the wash cycle. When other higher melting waxes were used instead of the petroleum jelly, initially high lathers were observed but these were controlled as the temperature rose toward the melting points. Similar satisfactory results were obtained when the melt of the calcium alkyl phosphate and petroleum jelly were sprayed directly onto the detergent base powder plus the sodium perborate. A paraffin wax melting at 110° F. was also used successfully in replacement for the petroleum jelly.

EXAMPLES 26 AND 27

A homogeneous mixture was prepared of 1 part of the calcium salt of a commercial mixture of predominantly monoalkyl $C_{16}$–$C_{18}$ phosphoric acid and 4 parts of petroleum jelly. 5 gms of the mixture was then added with thorough mixing to 200 gms of a commercially available soap powder and to 80 gms of a commercially available liquid fabric washing detergent product. Both products were used to wash a 5 lb load of soiled clothes in a Miele 429 washing machine at 95° C. in 24° H water. In both cases it was found that the lather level was controlled satisfactorily throughout the wash cycle. But when the original high sudsing soap powder and liquid detergent product were used the lather rose rapidly and overflowing started within about 10 minutes.

EXAMPLE 28

A detergent composition was prepared to the same formulation of Example 25, except that the calcium alkyl phosphate was replaced by the calcium salt of predominantly monoalkyl $C_{16}$–$C_{18}$-3 EO phosphoric acid. The composition was then used in a Miele 429 automatic washing machine to wash a 5 lb soiled load in 24° H water. The lather level remained low throughout the wash cycle, reaching a maximum level of about one third full (as measured in Examples 6 to 9).

What is claimed is:

1. A solid detergent composition for fabric washing in water comprising about 1% to about 90% by weight of an anionic, nonionic, amphoteric or zwitterionic detergent active compound and about 0.05% to about 20% by weight of a polyvalent salt of an alkyl phosphoric acid having the general formula:

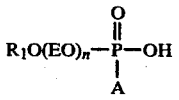

where A is —OH or $R_2O$, n is 0 and $R_1$ and $R_2$ are the same or different $C_{16-22}$ straight or branched chain, saturated or unsaturated alkyl groups, and containing about 0.05% to about 20% by weight of a mineral oil.

2. A solid detergent composition for fabric washing in water according to claim 1 wherein the polyvalent salt is a calcium salt.

3. A solid detergent composition for fabric washing in water according to claim 1 wherein A is —OH.

4. A solid detergent composition for fabric washing in water according to claim 1 wherein $R_1$ and $R_2$ are $C_{16-18}$ linear saturated alkyl groups.

5. A solid detergent composition for fabric washing in water according to claim 1 wherein the polyvalent salt of an alkyl phosphoric acid is present in about 0.1% to about 5%.

6. A solid detergent composition for fabric washing in water according to claim 1 wherein the mineral oil is present in about 0.5% to about 5% by weight of the composition.

7. A solid detergent composition for fabric washing in water according to claim 1 wherein the ratio of the polyvalent salt of an alkyl phosphoric acid to the mineral oil is about 1:20 to about 10:1 parts by weight.

8. A solid detergent composition for fabric washing in water according to claim 1 wherein the polyvalent salt of an alkyl phosphoric acid and the mineral oil are in substantially homogeneous admixture in the composition.

9. A solid detergent composition for fabric washing in water according to claim 1 comprising about 5% to about 50% by weight of an anionic detergent compound.

10. A solid detergent composition for fabric washing in water according to claim 1 comprising about 5% to about 80% by weight of an organic or inorganic detergency builder.

11. A lather control detergent additive for use in solid detergent compositions for aqueous fabric washing which comprises in substantially homogeneous admixture a polyvalent salt of an alkyl phosphoric acid having the general formula:

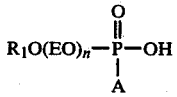

where A is —OH or $R_2O$, and n is 0 and $R_1$ and $R_2$ are the same or different $C_{16-22}$ straight or branched chain, saturated or unsaturated alkyl groups, and mineral oil, the ratio of the polyvalent salt of an alkyl phosphoric acid to the mineral oil being about 1:20 to about 10:1 parts by weight.

12. A lather control detergent additive according to claim 11 wherein the ratio of the polyvalent salt of an alkyl phosphoric acid to the mineral oil is about 1:10 to about 1:1 parts by weight.

13. A lather control detergent additive according to claim 11 wherein the polyvalent salt of an alkyl phosphoric acid is a calcium salt.

14. A lather control detergent additive according to claim 11 wherein A is —OH.

15. A lather control detergent additive according to claim 11 wherein $R_1$ and $R_2$ are $C_{16-18}$ linear saturated alkyl groups.

16. A process for forming a solid detergent composition for fabric washing in water according to claim 28, comprising forming a lather control detergent additive according to claim 11 and admixing the additive with an anionic, nonionic, zwitterionic or amphoteric detergent active compound.

17. A process according to claim 16 wherein the lather control detergent additive is sprayed onto a detergent base powder comprising the detergent active compound.

18. A process according to claim 16 wherein the lather control detergent additive is in granular form and is admixed with a detergent base powder comprising the detergent active compound.

* * * * *

UNITED STATES PATENT AND TRADEMARK OFFICE

CERTIFICATE OF CORRECTION

PATENT NO. : 4,362,642

DATED : December 7, 1982

INVENTOR(S) : Carter et al

It is certified that error appears in the above—identified patent and that said Letters Patent is hereby corrected as shown below:

Page 1, item [63], delete "Continuation of Ser. No. 757,165, Jan. 6, 1977, abandoned, which is a continuation of Ser. No. 55,714, Jul. 9, 1979, abandoned, which is a continuation of Ser. No. 162,987, Jun. 25, 1980, abandoned." and insert:

-- Continuation of Ser. No. 162,987, Jun. 25, 1980, abandoned, which is a continuation of Ser. No. 55,715, Jul. 9, 1979, abandoned, which is a continuation of Ser. No. 757,165, Jan. 6, 1977, abandoned. --

Column 1, delete lines 6 through 11 and insert:

-- This application is a continuation of application Ser. No. 162,987, filed June 25, 1980, now abandoned, which in turn is a continuation of application Ser. No. 055,715, filed July 9, 1979, now abandoned, which in turn is a continuation of application Ser. No. 757,165, filed Jan. 6, 1977, now abandoned. --

UNITED STATES PATENT AND TRADEMARK OFFICE

CERTIFICATE OF CORRECTION

PATENT NO. : 4,362,642

DATED : December 7, 1982

INVENTOR(S) : Carter et al

It is certified that error appears in the above-identified patent and that said Letters Patent are hereby corrected as shown below:

Claim 16, line 2, "in water according to claim 28"

should read --in water according to claim 1--

Signed and Sealed this

*Thirty-first* Day of *May 1983*

[SEAL]

*Attest:*

DONALD J. QUIGG

*Attesting Officer* *Acting Commissioner of Patents and Trademarks*